US005213624A

United States Patent [19]

Williams

[11] Patent Number: 5,213,624

[45] Date of Patent: May 25, 1993

[54] TERPENE-BASE MICROEMULSION CLEANING COMPOSITION

[75] Inventor: William A. Williams, Latrobe, Pa.

[73] Assignee: PPG Industries, Inc., Pittsburgh, Pa.

[21] Appl. No.: 732,565

[22] Filed: Jul. 19, 1991

[51] Int. Cl.[5] ..... C23G 5/036

[52] U.S. Cl. ..... 134/40; 252/548; 252/153; 252/174.21; 252/171

[58] Field of Search ..... 252/548, 153, 174.21, 252/171; 134/40

[56] References Cited

U.S. PATENT DOCUMENTS

| | | | |
|---|---|---|---|
| Re. 33,210 | 5/1990 | Stoufer | 252/153 |
| 3,642,644 | 2/1972 | Grote et al. | 252/153 |
| 3,728,265 | 4/1973 | Cella et al. | 252/DIG. 13 |
| 4,199,482 | 4/1980 | Renand et al. | 252/559 |
| 4,256,661 | 3/1981 | Egan et al. | 252/548 |
| 4,336,151 | 6/1982 | Like et al. | 252/106 |
| 4,336,152 | 6/1982 | Like et al. | 252/106 |
| 4,362,638 | 12/1982 | Caskey et al. | 252/90 |
| 4,414,128 | 11/1983 | Goffinet | 252/111 |
| 4,438,009 | 3/1984 | Brasky et al. | 252/90 |
| 4,455,250 | 6/1984 | Frazier | 252/106 |
| 4,511,488 | 4/1985 | Matta | 252/162 |
| 4,540,505 | 9/1985 | Frazier | 252/106 |
| 4,620,937 | 11/1986 | Dellutri | 252/143 |
| 4,640,719 | 2/1987 | Hayes et al. | 134/40 |
| 4,704,225 | 11/1987 | Stoufer | 252/153 |
| 4,859,359 | 8/1989 | De Matteo et al. | 252/174.15 |
| 4,867,800 | 9/1989 | Dishart et al. | 134/40 |

FOREIGN PATENT DOCUMENTS

| | | |
|---|---|---|
| 1120820 | 3/1982 | Canada . |
| 80749 | 6/1983 | European Pat. Off. . |
| 129987 | 1/1985 | European Pat. Off. . |
| 174711 | 3/1986 | European Pat. Off. . |
| 316726 | 5/1989 | European Pat. Off. . |
| 1603047 | 11/1981 | United Kingdom . |
| 2144763 | 3/1985 | United Kingdom . |

*Primary Examiner*—Patrick P. Garvin

*Attorney, Agent, or Firm*—Irwin M. Stein; Donna L. Seidel

[57] ABSTRACT

Oil-in-water microemulsion cleaning compositions comprising four principal components are described. These four components are a terpene solvent, e.g., d-limonene, an aliphatic glycol monoether co-solvent, e.g., dipropylene glycol monomethyl ether, a mixture of non-ionic surfactants selected from (1) a capped alkylphenol ethoxylate or an ethoxylated higher aliphatic alcohol, and (2) a fatty acid alkanolamide, and water. The cleaning composition may be used in concentrated form or in a diluted form. The composition may be used for cleaning soil from among others glass and metal parts.

8 Claims, No Drawings

TERPENE-BASE MICROEMULSION CLEANING COMPOSITION

DESCRIPTION OF THE INVENTION

The present invention relates to aqueous microemulsion cleaning compositions, to a process for their manufacture and the use of such compositions in cleaning applications. More particularly, the present invention relates to aqueous oil-in-water microemulsion cleaning compositions in concentrated or diluted form which, in the absence of any opacifying component, are clear, and which are particularly effective for cleaning oil and greasy soils from hard and flexible substrates, such as metal parts and glass surfaces. The cleaning compositions of the present invention comprise four essential or major components; namely, (a) a terpene hydrocarbon solvent; (b) a mixture of non-ionic surfactants including (i) a capped alkylphenol alkoxylate or alkoxylated higher aliphatic alcohol and (ii) a fatty acid alkanolamide; (c) a lower alkyl or phenyl monoether of an aliphatic glycol co-solvent; (d) and water.

In the manufacture of various articles, such as glass, metal parts or, for example, iron, steel, brass, aluminum, copper, etc., coated and uncoated automobile parts and circuit boards, a need arises during the manufacturing process to clean such articles of manufacture of soils involving deposits of oils, e.g., rolling oil, cutting oil and stamping oil, grease, dirt, waxes, silicones, etc. In the past, it has been customary to employ cleaning compositions based primarily upon the use of petroleum derived hydrocarbon solvents, e.g., petroleum distillates, such as n-hexane, or halogenated hydrocarbon solvents, e.g., methyl chloroform and CFC solvents. While these solvents are effective for the purposes for which they have been developed, they have become environmentally undesirable.

Terpenes are known components of perfume compositions and are often incorporated into detergent compositions at low levels via the perfume. Certain terpenes have also been included in cleaning or detergent compositions at higher levels. For instance, U.S. Pat. No. 4,336,151 describes a disinfectant/cleaner composition having broad spectrum germicidal activity and reduced eye irritancy by the combined use of a quaternary ammonium compound, non-ionic surfactant, d-limonene, water, and an eye-irritancy reducing compound such as ethoxylated cocodiethanolamide. U.S. Pat. No. 4,414,128 describes liquid detergent compositions for use as hard surface cleaners of 1–20% surfactant, 0.5–10% mono- or sesquiterpenes, and 0.5–10% of a polar solvent, e.g., benzyl alcohol, having a solubility in water of from 0.2 to 10%.

Water-in-oil detergent emulsions for use in laundry pre-spotting applications are described in U.S. Pat. No. 4,438,009. These emulsions comprise from 1 to 30% of (a) certain salts, such as sodium citrate, (b) from 1 to 35% of a non-ionic surfactant mixture of (i) a non-ethoxylated sorbitan surfactant, e.g., sorbitan monolaurate, (ii) another non-ionic surfactant, e.g., ethoxylated nonylphenols or ethoxylated primary alcohols, and (iii) an ethoxylated sorbitan surfactant, (c) from 5–60% of a hydrocarbon solvent, which may be d-limonene, and (d) water. D-limonene-based aqueous cleaning compositions are described in U.S. Pat. No. 4,511,488. Such compositions comprise from 78–96 parts of a d-limonene/surfactant/water mixture, 2–10 parts of coupling agent, e.g., glycols and lower alkyl glycol ethers, and 2–12 parts of additives. The surfactants used are anionic, non-ionic and mixtures of anionic and non-ionic surfactants.

U.S. Pat. No. 4,540,505 describes cleanser compositions containing from 0.4 to 1% d-limonene, quaternary ammonium compound, non-ionic surfactant, alkali builder and 4–6% of a monoether of an aliphatic glycol. U.S. Pat. No. 4,704,225 (Re. 33,210) describes water-in-oil cleaning emulsion of (a) an oil phase of 95 to 85 parts by volume of an terpene and 5 to 15 parts by volume of a $C_8$–$C_{18}$ fatty acid alkanolamide and (b) from 5 to 8 parts by volume of water per part by volume of the oil phase.

European Patent Application 80,749 describes liquid detergent compositions for use as a hard surface cleaner of terpene, surfactant and 2-(2-butoxyethoxy) ethanol. European Patent Application 174,711 describes a biodegradable emulsion for use in removing ink from printing presses of 50–75% d-limonene, 25–50% water, and 1–5% non-ionic surfactant, e.g., nonylphenol ethoxylates and N-substituted fatty acid amides, and 0.5–2% emulsion stabilizer, e.g., polypropylene glycol. Stable microemulsion cleaning compositions of synthetic organic (non-ionic/anionic) detergents (5–65%), perfume, e.g., terpenes (2–50%), water (15–85%) and co-surfactant, e.g., monoalkyl ether of a lower glycol (2–50%) are described in European Patent Application 316,726.

The present invention concerns the discovery of certain terpene-based cleaning compositions in the form of an oil-in-water microemulsion that are particularly suitable for cleaning hard or flexible substrates of soils involving deposits of, for example, oils, grease, dirt, etc. The foregoing microemulsions comprise a terpene solvent, a co-solvent of a lower alkyl monoether of an aliphatic glycol, water and a mixture of certain non-ionic surfactants.

DETAILED DESCRIPTION OF THE INVENTION

Terpene solvents that may be used to prepare the microemulsions of the present invention are preferably the mono- and bicyclic monoterpenes, i.e., those of the hydrocarbon class, which include, for example, the terpinenes, terpinolenes, limonenes, pinenes and mixtures thereof. Particularly preferred terpenes include d-limonene, dipentene, alpha-pinene, beta-pinene, the mixture of terpene hydrocarbons obtained from the essence of oranges, e.g., cold-pressed orange terpenes and orange terpene oil phase ex fruit juice, and the mixture of terpene hydrocarbons expressed from lemons and grapefruit. The foregoing terpene hydrocarbon solvents are derivatives of pine tree products or citrus by-products and, therefore, are naturally occurring materials. Numerous other terpene hydrocarbons are known to those skilled in the art and may be used to prepare the microemulsions of the present invention; however, those mentioned above are the most readily available and, hence, are preferred. Such materials are often formulated with small amounts, e.g., 0.1 weight percent, of auxiliary materials, such as stabilizers, e.g., antioxidants such as butylated hydroxytoluene, and such auxiliary materials are included within the meaning of the term "terpene solvent", as employed in this specification and the accompanying claims.

D-limonene is highly preferred as the terpene component of the microemulsion. It is derived from distilled orange rind oil and may be obtained in essentially pure form from citrus products companies which produce it as a by-product. An extensive discussion of d-limonene and its derivation from numerous sources is presented in a book by J. W. Kesterson et al entitled Florida Citrus Oil, published in December, 1971 by Agricultural Experiment Station, Institute of Food & Agricultural Sciences, University of Florida, Gainesville, Fla.

The terpene component is present in the concentrated microemulsion of the present invention in the range of from about 5 to about 20 weight percent, more usually, from about 10 to about 15 weight percent, e.g., about 12 weight percent. Corresponding terpene contents for a microemulsion that has been diluted with nine equal parts of water, thereby to form a microemulsion containing 10 percent of the concentrated microemulsion, are 0.5–2.0 weight percent, more usually, 1.0–1.5 weight percent, e.g., 1.2 weight percent.

Another major component of the microemulsion of the present invention is a lower alkyl or phenyl monoether of a $C_2$ or $C_3$ aliphatic glycol, e.g., ethylene glycol, diethylene glycol, propylene glycol and dipropylene glycol, or 1,5-dihydroxy-2-methyl pentane. This co-solvent material may be selected from materials represented in part by the following general formula, $$R_2O\text{-}(CH_2\text{—}CH(R_3)\text{—}O)_z\text{-}(CH_2\text{—}CH(CH_3)\text{—}O)_w\text{-}H \qquad (I)$$

In general formula I, $R_2$ may be selected from lower alkyl, e.g., $C_1$–$C_4$ alkyl, such as methyl, ethyl, propyl, n-butyl and t-butyl, and phenyl, $R_3$ is hydrogen or methyl, w is 0 or 1, and z is a number of from 1 to 2; provided that z is 1 and $R_3$ is hydrogen when w is 1.

Examples of materials exemplified by general formula I that may be used to prepare the microemulsion of the present invention include, but are not limited to, the monomethyl ethers, monethyl ethers, monobutyl ethers, and the phenyl ethers of monoethylene glycol, diethylene glycol, monopropylene glycol, and dipropylene glycol; the methyl, ethyl and butyl ethers of 2-ethoxy propanol; and the methyl ether of 1,5-dihydroxy-2-methyl pentane. Mixtures of such co-solvents may also be used.

The co-solvent component may be present in the range of from about 10 to about 35 weight percent, more usually from about 15 to about 25 weight percent, e.g., about 20 weight percent. Corresponding contents of the co-solvent for a microemulsion diluted with 9 parts of water so as to form a composition containing 10 percent of the concentrated microemulsion are 1.0–3.5 weight percent, more usually 1.5–2.5 weight, e.g., about 2.0 weight percent. Typically the ratio of co-solvent to terpene hydrocarbon will range from about 1.2:1 to about 4.0:1, more usually from about 1.5:1 to 2.0:1.

A further major component of the microemulsion of the present invention is a mixture of certain non-ionic surfactants. The first non-ionic surfactant is a capped alkylphenol alkoxylate and/or higher aliphatic alcohol alkoxylate. The second non-ionic surfactant that is a part of the surfactant mixture is a fatty acid alkanolamide.

Capped alkylphenol alkoxylates that may be used as the first non-ionic surfactant may be represented by the following general formula, $$(R)_a\text{—}Ph\text{—}O\text{-}(A\text{—}O)_y\text{-}(CH_2\text{—}CH_2\text{—}O)_x\text{-}B \qquad (II)$$

wherein R is a $C_8$–$C_{12}$, aliphatic group, e.g, $C_{8-C10}$ alkyl, such as octyl, nonyl, decyl, undecyl and dodecyl, Ph is phenylene, A is a bivalent alkyleneoxy group selected from the group consisting of propyleneoxy, butyleneoxy and a mixture of propyleneoxy and butyleneoxy groups, B is selected from the group consisting of benzyl, methyl, ethylchloro and polypropyleneoxy, i.e., $\text{-}(CH_2\text{—}CH(CH_3)\text{—}O)_b\text{-}H$, a is the integer 1 or 2, b is a number from 3 to 4, x is a number of from 6 to 20, e.g., 10–16, and y is a number from 0 to 4, e.g., 1–4, such as 2, 3 or 4.

Examples of capped alkylphenol alkoxylates within the scope of general formula II include the benzyl, methyl and chloro ether of octylphenoxy polyethoxy ethanol containing from about 10 to 16 ethoxy units. Similarly, there can be mentioned the dioctyl phenoxy polyethoxy ethanols, and the nonyl-, decyl- and dodecyl-phenoxy polyethoxy ethanols containing from 10 to 16, e.g., 13 to 16, ethoxy units and capped with a benzyl, methyl, ethylchloro or polypropyleneoxy group. The methyl and benzyl capped alkylphenol alkoxylates may be prepared by the art recognized Williamson synthesis. The polypropyleneoxy capped alkylphenol alkoxylates may be prepared by the conventional alkoxylation addition reaction to the hydroxy-terminated alkylphenol alkoxylate with propylene oxide. The chloro capped alkylphenol alkoxylate may be prepared by reacting the hydroxy- terminated precursor with thionyl chloride and decomposing the intermediate chlorosulfite to the organo chloride by means known in the art.

Alkoxylated higher aliphatic alcohol non-ionic surfactants that may be used in place of (or as partial substitution for) the alkylphenol alkoxylates as the first non-ionic surfactant may be represented by the following general formula, $$R''\text{—}O\text{-}(A\text{—}O)_y\text{-}(CH_2\text{—}CH_2\text{—}O)_x\text{-}H \qquad (III)$$

R'' is a $C_8$–$C_{12}$ linear or branched chain alkyl, preferably a $C_{10}$–$C_{18}$ alkyl, e.g., a $C_{12}$–$C_{13}$ alkyl. A, x and y in general formula III are as defined hereinabove with respect to the alkylphenol alkoxylates of general formula II. When both the capped alkylphenol alkoxylate and alkoxylated aliphatic alcohol are used in combination as the first non-ionic surfactant, they may be used in a ratio of about 5:1 to 1:5, e.g., 1:1.

Alkoxylated aliphatic alcohols within the scope of general formula III may be prepared by performing conventional alkoxylation addition reactions on commercially available aliphatic alcohols, which are commonly available as mixtures of alcohols. Examples of such materials include ethoxylated mixed aliphatic alcohols having from 8 to 10 carbon atoms and 6 to 10 ethoxy units; ethoxylated mixed aliphatic alcohols having from 9 to 11 carbon atoms and 6 to 10 ethoxy units; ethoxylated mixed aliphatic alcohols having from 12 to 15 carbon atoms and 10 to 15 ethoxy units; an ethoxylated $C_{12}$ aliphatic alcohol having from 10 to 15 ethoxy units; an ethoxylated isodecyl alcohol having from 8 to 10 ethoxy units; and an ethoxylated linear or branched octyl alcohol having from 2 to 10 ethoxy units.

The above-described alkylphenol alkoxylates and alkoxylated aliphatic alcohol non-ionic surfactants may be prepared by condensing the corresponding aliphatic alcohol or alkylphenol with alkylene oxide groups, e.g., ethylene oxide, in a manner known in the art. The value for x in general formulae II and III is the average number of ethoxy groups resulting from the aforesaid condensation, as is known in the art.

In those embodiments wherein y is other than 0, the aliphatic alcohol or alkylphenol is first condensed with propylene oxide, butylene oxide or a combination of butylene oxide and propylene oxide. The resulting alkoxylated alkyl phenol or aliphatic alcohol is then further condensed with ethylene oxide to prepare the precursor to the surfactant material of general formulae II, and the surfactant material of general formula III. When mixtures of butylene oxide and propylene oxide are used, the resultant product may be a block polymer or random polymer, e.g., first condensing butylene oxide and then propylene oxide or condensing a mixture of butylene oxide and propylene oxide with the alkylphenol or aliphatic alcohol. When y is other than 0 or 1, the value for y is an average number of alkoxy groups which results from the condensation reaction, as is known in the art. When A is a mixture of butyleneoxy and propyleneoxy groups, y represents the total number of butyleneoxy and propyleneoxy groups.

The second non-ionic surfactant used in the surfactant mixture is a fatty acid alkanolamide, which may be represented by the following general formula, $$R'—C(O)—N(R_1)CH_2CH_2OH \quad (IV)$$

wherein R' is a $C_{12}$–$C_{18}$ aliphatic group, and $R_1$ is hydrogen or hydroxyethyl. Preferably, $R_1$ is hydroxyethyl.

Examples of fatty acid alkanolamides that may be used to prepare the microemulsions of the present invention include cocodiethanolamide (cocoamide DEA), lauramide DEA, soyamide DEA, oleylamide DEA, stearamide DEA, linoleamide DEA, tall oil amide DEA, tallow amide DEA, and stearamide monoethanolamide (stearamide MEA).

As described, R'—C(O)—of general formula IV is a derivative of a fatty acid or a mixture of fatty acids. Coconut oil fatty acids are preferred and comprise a mixture of mainly caprylic acid, capric acid, lauric acid, myristic acid, palmitic acid, stearic acid, oleic acid and linoleic acid. Derivatives of fatty acids containing from 12 to 18 carbon atoms and particularly lauric acid are preferred. The preferred coconut oil fatty acid diethanolamide used herein is that produced by condensing 1 mole of diethanolamine with 1 mole of the fatty acid mixture derived from coconut oil.

The non-ionic surfactants described above may be present in the concentrated microemulsion in amounts of from about 30 to about 50 weight percent, more usually from about 35 to about 45 weight percent, e.g., about 38 weight percent. The weight ratio of the capped alkylphenol alkoxylate and/or alkoxylated higher aliphatic alcohol surfactant to the fatty acid alkanolamide surfactant may range from about 2:1 to about 5:1, more typically from about 2.5:1 to about 4:1, e.g., about 3.7:1.

The amount of non-ionic surfactants used to prepare the microemulsions of the present invention, vis-a-vis, the terpene hydrocarbon solvent is usually not less than 2 parts of non-ionic surfactant per 3 parts of terpene hydrocarbon solvent, i.e., not less than 1 part of non-ionic surfactant for each 1.5 parts of terpene hydrocarbon solvent.

The last major ingredient of the microemulsion of the present invention is water. Ordinary tap water, usually of less than 150 p.p.m. hardness, as $CaCO_3$, distilled water or deionized water may be used. Tap water of less than 50 p.p.m. hardness, as $CaCO_3$, is preferred for reasons of cost. The amount of dissolved impurities normally in tap water does not appear to affect adversely the microemulsion cleaning compositions of the present invention.

Water is used in the described and claimed concentrated microemulsions in amounts and quantities sufficient so that the total of all four major components adds to 100 percent. Thus, the microemulsion of the present invention comprises, for example, (a) the terpene hydrocarbon solvent, (b) the lower alkyl glycol monoether co-solvent, (c) a mixture of non-ionic surfactants, e.g., capped alkylphenol ethoxylate and fatty acid alkanolamide, and (d) the balance water.

Other suitable non-essential (non-major) ingredients that may be added to the concentrated microemulsion of the present invention to impart desirable properties include rust inhibitors, scale inhibitors, defoamers, chelates, preservatives, biocides, pH buffering materials such as alkali metal carbonates, bicarbonates, metasilicates and orthophosphates, dyes, perfumes, enzymes and soil suspending agents such as carboxy methyl cellulose. These ingredients may be added in amounts of from 0 to about 30 parts by weight, based on 100 parts of the concentrated microemulsion. More typically, from about 5 to about 20, e.g., up to about 10 percent by weight of these additional ingredients or adjuvants may be incorporated into the concentrated microemulsion.

The concentrated microemulsion of the present invention may be diluted by mixing one (1) part thereof with from about 1 to about 49 parts of water with 1 part of the concentrated microemulsion. More typically, the concentrated microemulsion may be diluted by mixing up to 20, e.g., 2 to 10, parts of water with 1 part of the concentrated microemulsion. The more dilute microemulsion may be used for light cleaning applications, while the more concentrated microemulsions, for example, the concentrated microemulsion and those diluted with about 9 parts of water are used for heavier duty cleaning applications. Even when diluted, the microemulsion remains clear.

The microemulsions of the present invention possess properties that are particularly beneficial as cleaning compositions. As a microemulsion, the composition is clear and inherently stable. It is free rinsing, i.e., it does not require significant additional rinsing—little or no residue remaining on the surface cleaned with the concentrated or diluted microemulsion cleaning composition. The microemulsion cleaning compositions (concentrated and diluted) of the present invention are highly effective in removing oils, particularly aliphatic and aromatic oils from hard surfaces, and have low VOC (volatile organic compound) values. When diluted the microemulsion has a high flash point, as measured by the Pensky Martens Closed Cup (P.M.C.C.) Method. For example, when diluted to 20 percent or less, the flash point of the microemulsion is greater than 212° F.

In most cleaning applications using the microemulsion of the present invention, low foaming is experienced during the cleaning operation. In high pressure washing applications, the foam produced is low to moderate. Further, the microemulsion cleaning composition of the present invention is compatible with high soil loads, which suggests an extended bath life. For example, a diluted aqueous microemulsion cleaning composition of the present invention containing 10 percent of the concentrated microemulsion has been found capable of performing additional cleaning even in the presence of a 10 percent contamination load.

Finally, the cleaning compositions described herein are compatible with materials of construction such as elastomers, rubber, and thermoset resins, i.e., they do not swell, attack or craze many of such materials used for articles such as gaskets and piping.

The microemulsion compositions of the present invention are particularly useful for cleaning oily and greasy soils from substrates, e.g., hard surfaces. It also may be adapted for cleaning textiles, for example, woven or knit cotton or cellulose-synthetic blend, e.g., cotton-polyester textile materials. It is also contemplated that the cleaning compositions of the present invention may be used as a laundry pre-spotting composition.

The microemulsion cleaning compositions of the present invention may be prepared by simply combining all of the organic components thereof in a suitable vessel or container with sufficient agitation and then adding the amount of water required to make up 100 parts. The order of mixing the organic components is not particularly important and generally the various organic materials may be added sequentially or all at once. Preferably, the compositions of the present invention are prepared by mixing the organic components until the mixture is clear and then add slowly the required amount of water. Typically, good manufacturing procedures involve adding the largest (in amount) component first, and adding the most volatile component last. Preferably, the pH of the microemulsion is from about 6 to 9 for cleaning applications. Diluted microemulsions may be made from the concentrated microemulsion by dilution with the appropriate amount of water.

The microemulsion cleaning compositions of the present invention may be used in a wide variety of methods which will vary according to the amount of soil to be removed and the size and shape of the article to be cleaned. Application of the cleaning composition can, for example, be by brushing, spraying, air or immersion dipping, hosing and wiping. Cleaning may be by batch or continuous methods. It has been surprisingly found that the diluted microemulsions of the present invention are effective when used with ultrasonic cleaning methods. Preferably, the cleaning compositions of the present invention are used at temperatures up to 160° F., e.g., from ambient temperatures, e.g., about 70° F., to 160° F. Contact times of the article with the cleaning composition are usually for from about 1 to 5 minutes, e.g., 3 minutes.

The present invention is more particularly described in the following example, which is intended as illustrative only, since numerous modifications and variations therein will be apparent to one skilled in the art.

EXAMPLE

A concentrated microemulsion cleaning solution was prepared by mixing the following organic ingredients and then adding the water:

| | |
|---|---|
| Cocodiethanolamide | 6.66 parts |
| Benzyl capped octyl phenol ethoxylate* | 24.99 parts |
| Dipropylene glycol monomethyl ether | 16.66 parts |
| D-limonene | 9.99 parts |
| Mazon ® RI 6 corrosion inhibitor | 16.7 parts |
| Water | 25.00 parts |

*Contains about 16 ethoxy units 13.5 gallons of the concentrated microemulsion were diluted with tap water having a total hardness of 156 p.p.m. as combined $Ca/MgCO_3$ to a total of 135 gallons. The diluted microemulsion was used to clean metal parts in a 4 stage tester designed to simulate commercial degreasing equipment. The four stages were (1) wash, (2) first rinse, (3) second rinse, and (4) forced hot air (157° F.) dry. The cleaning conditions (temperature (T) and spray pressures (P), psi) for each of the first three stages and the parts cleaned are tabulated in Table 1. The surfaces of the parts cleaned were soiled with non-aqueous metal working fluids, e.g., lubricating, rolling and machine oils.

In Tests 1 and 2, the parts were placed in a metal cage and rotated in the cleaning composition at a speed of 5 rpm/minute. In Tests 3 and 4, the parts were dipped in the cleaning composition, and in Test 5 the fittings were sprayed with the cleaning composition. Rinsing in the second stage was by immersion in water and liquid spray below liquid level. In the third stage, air bubbled up from the bottom of the vessel through the water rinse bath in which the parts were immersed.

TABLE 1

| Test | | STAGES | | | | | | | |
|---|---|---|---|---|---|---|---|---|---|
| | | First/Wash | | Second/Rinse | | Third/Rinse | | Time | |
| No. | Parts Cleaned | °F. | P/psi | T, °F. | P, psi | T, °F. | P, psi | Minutes[c] | Result |
| 1 | Steel Bearing Cases | 140 | 78 | 128 | 50 | 66 | 15 | 1 | Clean |
| 2 | Steel Bearing Cases | 99 | 35 | 99 | 52 | 68 | 15 | 3 | 99% Clean |
| 3 | Aluminum Carburetor Parts | 98 | 35 | 96 | 50 | 68 | 15 | 3 | 90% Clean |
| 4 | Aluminum Carburetor Parts | 96 | —* | 90 | 54 | 70 | 15 | 3 | Clean |
| 5 | Brass Fittings[a] | 118 | 35[b] | 93 | 50 | 72 | 15 | 3 | Clean |

*Ultrasonically cleaned using a 40 Megahertz Ultrasonic Generator
[a]Used a 2 percent cleaning solution
[b]35 psi air spray
[c]Time in each stage The data of Table 1 shows that excellent cleaning of the metal parts was obtained in a short time at moderate temperature using a 10% aqueous microemulsion of the present invention rather than halohydrocarbons.

No appreciable foam was observed after two days of continuous operation in the tank used for the second rinse stage, which confirms the free rinsing properties of the cleaning composition. The data also shows that the dilute microemulsion of the present invention was effective using ultrasonic cleaning. The data of Test 2 shows that the cleaning composition of the present invention is relatively effective at lower temperatures and pressures, vis-a-vis, Test 1 and that longer times in each stage, e.g., 4 minutes is needed to completely clean the parts.

Although the present invention has been described with reference to the specific details of certain embodiments thereof, it is not intended that such details should be regarded as limitations upon the scope of the invention except as and to the extent that they are included in the accompanying claims.

I claim:

1. A cleaning composition in concentrated form consisting essentially of an oil-in-water microemulsion of:

(a) from about 5 to about 20 weight percent of terpene hydrocarbon solvent, (b) from about 30 to about 50 weight percent of a non-ionic surfactant mixture of:

(1) a first nonionic surfactant selected from the group consisting of:

(i) capped alkylphenol alkoxylate surfactant represented by the general formula, $$(R)_a Ph—O\text{-}(A—O)_y\text{-}(CH_2—CH_2—O)_x B,$$

wherein R is a $C_8$–$C_{12}$ alkyl, Ph is phenylene, A is a bivalent alkyleneoxy group selected from the group consisting of propyleneoxy, butyleneoxy and mixtures of propyleneoxy and butyleneoxy groups, B is selected from the group consisting of benzyl, methyl, ethylchloro and $\text{-}(CH_2—CH(CH_3)—O)_b H$, a is the integer 1 or 2, b is a number from 3 to 4, x is a number of from 6 to 20, and y is a number from 0 to 4, and (ii) an alkoxylated aliphatic alcohol surfactant represented by the general formula, $$R''—O\text{-}(A—O)_y\text{-}(CH_2—CH_2—O)_x H.$$

wherein R'' is a $C_8$–$C_{18}$ alkyl, and A , x and y are as defined hereinabove, and (2) a second nonionic surfactant comprising a fatty acid alkanolamide, produced by condensing equimolar amounts of amine and fatty acid, represented by the general formula, $$R'—C(O)—N(R_1)CH_2CH_2OH,$$

wherein R' is a $C_{12}$–$C_{18}$ aliphatic group and $R_1$ is hydrogen or hydroxyethyl, the weight ratio of surfactant (1) to surfactant (2) being from about 2:1 to about 5:1, and (c) from about 10 to about 35 weight percent of a monoether co-solvent represented by the general formula, $$R_2O\text{-}(CH_2—CH(R_3)—O)_z\text{-}(CH_2—CH(CH_3)—O)_w H.$$

wherein $R_2$ is selected from the group consisting of a $C_1$–$C_4$ alkyl and phenyl, $R_3$ is a hydrogen or methyl, w is 0 or 1, and z is a number of from 1 to 2, provided that z is 1 and $R_3$ is hydrogen when w is 1, and (d) the balance water.

2. The cleaning composition of claim 1 comprising:

(a) from about 10 to about 15 weight percent of terpene hydrocarbon solvent, (b) from about 35 to 45 weight percent of the non-ionic surfactant mixture, (c) from about 15 to about 25 weight percent of the monoether co-solvent, and (d) the balance water.

3. The cleaning composition of claim 2 wherein the terpene hydrocarbon solvent is d-limonene; the first non-ionic surfactant is a monoalkylphenol ethoxylate wherein a is 1, y is 0, and B is benzyl; the second non-ionic surfactant is a diethanolamide and $R_1$ is hydroxyethyl; and the monoether co-solvent is one wherein $R_2$ and $R_3$ are each methyl.

4. A cleaning composition comprising one part of the concentrated composition of claim 3 diluted with 9 parts of water.

5. The cleaning composition of claim 3 wherein the first non-ionic surfactant is a benzyl capped octyl phenol ethoxylate containing from about 10 to 16 ethoxy units, the second non-ionic surfactant is cocodiethanolamide, and the monoether co-solvent is the monomethyl ether of dipropylene glycol.

6. A method of cleaning metal parts, comprising contacting said parts with the cleaning composition of claim 3 for a time and temperature sufficient to remove the soil contained on the surface of said parts.

7. The method of claim 6 wherein the time is from about 1 to 5 minutes.

8. The method of claim 6 wherein the parts are ultrasonically cleaned.

* * * * *